United States Patent [19]

Edmondson

[11] Patent Number: 4,854,616

[45] Date of Patent: Aug. 8, 1989

[54] DOOR LATCH ASSEMBLY WITH SEE-THROUGH CAPABILITIES

[76] Inventor: Peter C. Edmondson, 16 Stadler, Woodside, Calif. 94062

[21] Appl. No.: 98,577

[22] Filed: Sep. 18, 1987

[51] Int. Cl.[4] ..... E05C 1/12

[52] U.S. Cl. ..... 272/173; 292/DIG. 53; 292/356; 292/347

[58] Field of Search ..... 292/173, 357, 356, 358, 292/336.3, 336.5, 152, 347, 163, 165, 170, DIG. 38, DIG. 62, DIG. 53, DIG. 52, 1; 362/100

[56] References Cited

U.S. PATENT DOCUMENTS

| | | | |
|---|---|---|---|
| 1,159,635 | 11/1915 | Wolfe | 292/DIG. 52 |
| 2,160,762 | 5/1939 | Stenberg | 292/337 |
| 2,309,840 | 2/1943 | Garvert | 362/100 |
| 2,924,480 | 2/1960 | Holland | 292/356 |
| 3,211,486 | 10/1965 | Crandell | 292/356 |
| 3,750,433 | 8/1973 | Sanders | 292/356 |
| 3,829,137 | 8/1974 | MacDonald | 292/171 |
| 3,955,075 | 5/1976 | Susedik | 362/100 |
| 4,234,909 | 11/1980 | Cotroneo | 362/100 |

FOREIGN PATENT DOCUMENTS

| | | | |
|---|---|---|---|
| 485691 | 10/1929 | Fed. Rep. of Germany | 292/336.5 |
| 432769 | 12/1911 | France | 362/100 |
| 751498 | 9/1933 | France | 292/356 |

*Primary Examiner*—Richard E. Moore
*Assistant Examiner*—Eric K. Nicholson
*Attorney, Agent, or Firm*—Townsend and Townsend

[57] ABSTRACT

A door latch assembly for a door in which the latch assembly has a member which is transparent or translucent to allow light to pass therethrough and being operable to support a door knob structure.

22 Claims, 2 Drawing Sheets

DOOR LATCH ASSEMBLY WITH SEE-THROUGH CAPABILITIES

This invention relates to improvements in latch apparatus for doors and, more particularly, to door latch assembly which is decorative in appearance as well as functional in operation.

BACKGROUND OF THE INVENTION

Swinging doors have latch mechanisms which are concealed in the doors and generally there is nothing decorative about the external appearance of such a latch mechanism other than to provide for ornate door knobs, keyhole plates and the like. Because of the desire of homeowners and others to improve the decor of rooms of a home, there is an ongoing need to enhance the ornamentation of hardware for doors, windows and the like, and especially for doors which, except for door knobs therein, do not get sufficient attention of interior decorators when improving a home. The present invention is directed to the satisfaction of this need by providing an attachment for a door which is both aesthetic in appearance and functional in operation and which is easily implemented in existing or new doors of all sizes and types.

SUMMARY OF THE INVENTION

The present invention is directed to a door latch assembly for a door in which the latch assembly has as an integral part a member which is transparent or translucent to allow light to pass therethrough. Thus, the member, while serving as a functional part of the latch assembly itself, also serves to provide an aesthetic effect in that the door knob structure coupled to the member appears to be suspended in space and to have no apparent mechanical connection with any other part of the latch assembly or the door. Thus, the latch assembly of the present invention provides ornamentation for a door which serves not only to enhance the decor of a room but also serves to stimulate the interest in persons observing the door because of the capability of the latch assembly to pass light therethrough while seemingly providing no apparent support for the door knob structure coupled to the member.

The primary object of the present invention is to provide a latch assembly for a door in which the latch assembly includes a member through which light can pass, the member being operable to support a door knob structure yet the member is of a material which is such that a door knob structure appears to be mounted in space with no apparent mechanical connection to any other part of the door latch assembly or the body to thereby enhance the ornamentation of the door as well as to stimulate the interest in persons observing door and latch mechanism mounted on the door.

Other objects of this invention will become apparent as the following specification progresses, reference being had to the accompanying drawings for an illustration of the invention.

IN THE DRAWINGS

Figure 3:
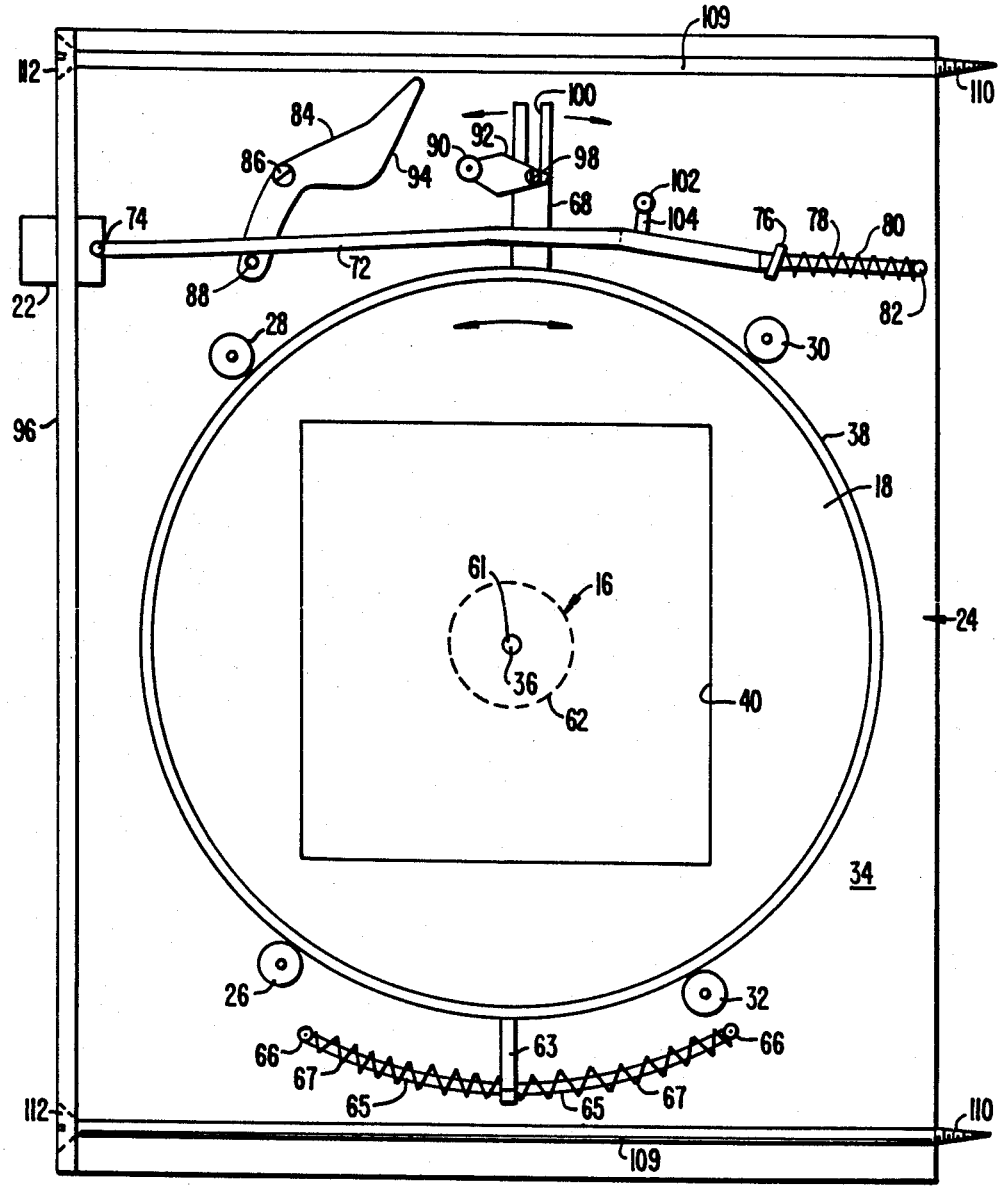
FIG 3 is a side elevational view of the door latch assembly of the present invention.

The door latch assembly of the present invention is broadly denoted by the numeral 10 and is adapted to be used with a door 12 having spaced hinges 14 for mounting the door for swinging movement about a generally vertical axis through the hinges. The door knob assembly 10 includes a door knob structure 16 coupled to a see-through member 18 through which light can pass. Thus, the panel is transparent or translucent.

Figure 2:
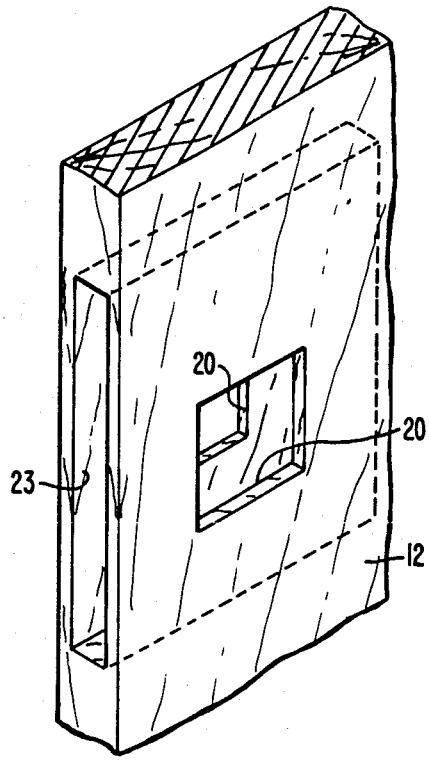
FIG. 2 is an enlarged, fragmentary perspective view of the door showing a mortise and a pair of aligned holes therein.

The member 18 can be made of glass, tempered glass or plastic and typically is disk shaped as hereinafter described. The member 18 is viewable through a pair of spaced holes 20 in door 12 as shown in FIG. 2, the holes 20 communicating with a mortise 23 extending into the door from the end face 25 of the door.

Figure 1:
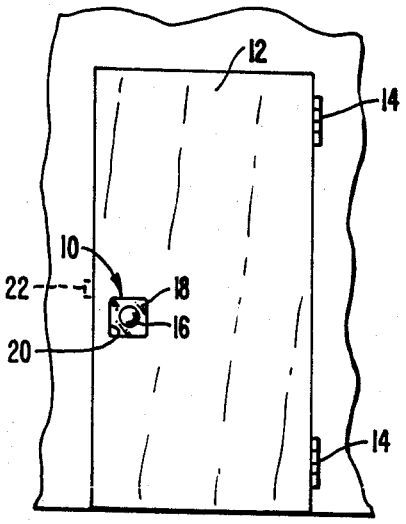
FIG. 1 is a front elevational view of a swinging door having the door latch assembly of the present invention coupled therewith.

The member 18 is rotated by manual rotation of door knob assembly 16 to retract a latch bolt 22 into the door. Release of the turning force on the door knob structure 16 causes the latch bolt 22 to return to its extended or operative position shown in dashed lines in FIG. 1.

The fact that the member 18 is transparent or translucent provides not only an aesthetic effect but also a functional effect which cannot readily be discerned by looking at the door knob structure or at the member 18 itself. Generally, the surface of the member 18 will be sufficiently clear of visible marks so that rotation of the member is not apparent. Thus, the average person will not be able to determine how the door latch assembly operates, and the assembly will appear to have a seemingly magical effect in that door knob assembly 16 appears to be suspended in space. This effect will stimulate the interest of the user of the door yet the assembly 10 is operative at all times upon rotation of the knob structure 16.

Latch assembly 10 includes a support in the nature of a plate having a number of bearings 26, 28, 30 and 32 mounted on the inner face 34 of the plate for rotation about generally horizontal axes. The bearings are adapted to support member 18 at the outer periphery thereof so that the member is rotatable about its central axis 36 which is generally horizontal when the latch assembly 10 is properly installed in the door. To facilitate the support of the member 18, a cylindrical band 38 is mounted in any suitable manner in surrounding relationship on the outer periphery of member 18, and the band engages the cylindrical outer surfaces of bearings 26, 28, 30 and 32 as shown in FIG. 3.

Plate 24 has a hole 40 therethrough which is generally rectangular or square in configuration. Hole 40 is aligned with holes 20 (FIG. 2) in door 12 when assembly 10 is installed in the door.

Figure 5:
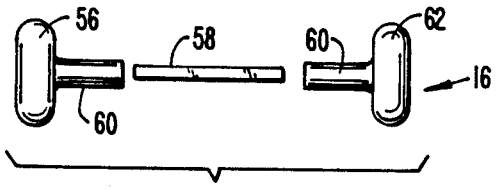
FIG. 5 is a door knob structure for attachment to the see-through member of the door latch assembly of the present invention.

Member 18 has door knob structure 16 thereon to permit manual rotation of the member about its central axis 36 in either direction. To this end, door knob structure 16 includes a pair of door knob elements 56 and 62 (FIG. 5). Elements 56 and 62 have sleeves 60 thereon for receiving respective ends of a shaft 58 which connects sleeves 60 to shaft 58. The shaft has flats on it for engaging the inner surfaces of a hole 61 (FIG. 3) through member 18 when shaft 58 extends through hole 61. Thus, door knob structure 16 is releasably but rigidly secured to member 18 so that manual turning or rotation of either element 56 or 62 in either direction will cause rotation of member 18 in the same direction.

A rigid tab 63 is secured to and extends radially outwardly and downwardly from band 38 as shown in FIG. 3. Tab 63 has a pair of curved rods 65 which extend laterally from the outer end of tab 63 in opposed directions. Coil springs 67 receive respective rods 65 and the outer ends of the springs 67 are secured to pins 66 which are rigid to plate 24. Rods 65 move relative to and past pins 66 when member 18 is rotated in opposite directions. As the member 18 is rotated in one direction, the corresponding spring 67 is compressed to increase the bias force on tab 63, tending to return member 18 to its equilibrium position shown in FIG. 3.

Figure 4:
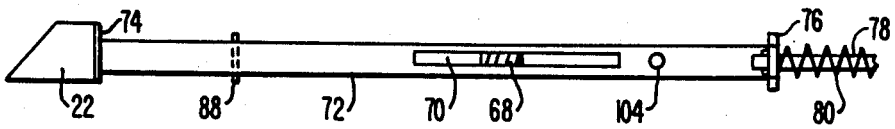
FIG. 4 is a top plan view of the link mechanism for coupling the see-through member of the assembly to a latch bolt thereof.

A second, rigid tab 68 is rigid to and extends radially outwardly from band 38 near the top of the band as shown in FIG. 3. Tab 68 extends through a slot 70 in a link 72 which is pivotally secured by a pin 74 at one end thereof to the inner end of latch bolt 22 (FIG. 3) and at the opposite end to a washer 76 which is slidably received on a rod 78 having a coil spring 80 surrounding the same. One end of the end coil spring and one end of the rod 78 are connected to the pin 82 (FIG. 3). Thus, movement of link 72 to the right when viewing FIGS. 3 and 4 will cause spring 80 to compress further and to increase the bias force on link 72, tending to move it to the left when viewing FIGS. 3 and 4.

A first bearing member 84 is pivotally mounted by a pin 86 on support plate 24 at a location above link 72 and between tab 68 and latch bolt 22. The pin 86 is intermediate the ends of bearing 84, and the bearing is pivotally mounted to a pin 88 rigidly carried by link 72 near pin 74 as shown in FIG. 3.

A bearing 90 carried by a projection 92 on tab 68 is normally spaced from an inclined bearing surface 94 on bearing 84 yet the bearing 90 is aligned with bearing surface 94 so that, for sufficient angular travel of tab 68 about the central axis 36 of member 18, bearing 90 will engage surface 94 and rotate bearing 84 in a counter clockwise sense (viewing FIG. 3) about the axis of pin 86. This will cause the lower end of bearing 84 to move link 72 to the right when viewing FIG. 3, causing latch bolt 22 to be pulled to the right and into a retracted position in which the outer end of the latch bolt is substantially within or interiorly of a latch plate 96 secured and extending outwardly from one end margin of support plate 24. There will be some lost motion of tab 68 in slot 70 before bearing 90 engages bearing surface 94. This lost motion is provided to allow for an average angle of rotation, such as 15 to 20 degrees, of member 18 before bearing 84 is pivoted in a clockwise sense about the axis of pin 86, tending to retract latch bolt 22.

As link 72 moves to the right to retract latch bolt 22, spring 80 is compressed to increase the bias force on the link 72, tending to return it to its equilibrium position shown in FIG. 3. Also, one of the springs 67 will be compressed and it, too, will tend to return member 18 to its equilibrium position shown in FIG. 3. Projection 92 is adjustably mounted by a set screw 98 (FIG. 3) in a slot 100 in tab 68 so that bearing 90 can adjustably engage any portion of the inclined bearing surface 94 of bearing 84 to increase or decrease the amount of lost motion provided by tab 68 in slot 70.

A bearing 102 is carried by a projection 104 on link 72 in alignment with the adjacent side edge of tab 68. As soon as the tab 68 has moved through the slot 70, the tab will engage bearing 102 and move it and thereby link 72 to the right when viewing FIG. 3, pulling latch bolt into its retracted position against the bias force of spring 80. This occurs when a clockwise rotation of member 18 is caused by manual turning of one of the door knob elements 56 or 62. Also, one of the springs 67 will be further compressed, to increase the bias force on tab 63 and thereby tending to return member 18 to its equilibrium position shown in FIG. 3. Thus, member 18 can be rotated in wither direction to cause retraction of the latch bolt 22.

In use, assembly 10 is constructed in the manner shown in FIG. 3. Door 12 is provided with a mortise 23 and with holes 20. Assembly is then inserted into mortise 23 and the assembly can be secured in place in a door in any suitable manner, such as by long screws 109 having threaded ends 110 and heads 112. The heads are countersunk in latch plate 96 and threaded ends 110 are threaded into the door 12. When so mounted, hole 40 of plate 24 is in alignment with holes 20 of door 12 and only member 18 is viewable when looking through holes 20. Then, knob structure 16 is coupled to member 18 to complete the mounting of assembly 10 in the door.

When properly mounted, the portion of member 18 viewable through hole 40 and holes 20 will appear to be no structure whatsoever in the hole if the member 18 is transparent. If it is translucent, the member will transmit light and except for the effect of reflected light, will not appear to be connected to the door knob structure. The door knob structure will, therefore, appear to be suspended in space. The presence of the member is not apparent unless visible marks are on the member and such marks are noticeable when door knob structure 16 is rotated.

When it is desired to move latch bolt 22 to its retracted position from its extended or operative position shown in FIG. 3, such as when a door is to be opened, one of the door knob elements 56 and 62 is rotated in a particular sense, such as a clockwise sense when viewing FIG. 3. This causes lost motion of tab 68 in slot 70 until the tab engages bearing 102, whereupon the tab further moves the bearing to the right, pulling link 72 and latch bolt 22 to the right until the latch bolt is retracted into the space bounded by latch plate 96. Movement of link 72 to the right increases the bias force exerted on the link by spring 80. Also, clockwise rotation of member 18 increases the bias force of one of the springs 67 on tab 63. Thus, link 72 is biased to the left at all times when viewing FIG. 3 and springs 67 bias member 18 into an equilibrium position shown in FIG. 3.

Counter clockwise rotation of member 18 also retracts latch bolt 22 by causing bearing 90 to engage bearing surface 94 after lost motion has been caused by movement of tab 68 in slot 70. When bearing 90 engages surface 94, continued movement of tab 68 to the left when viewing FIG. 3 causes counter clockwise rotation of bearing 84 about pin 86, causing pin 88 and thereby link 72 to move to the right when viewing FIG. 3, thereby retracting latch bolt 22. Again, spring 80 is compressed as is one of the springs 67, whereupon release of the turning force on the door knob structure returns link 72 and member 18 to their equilibrium positions under the bias forces of such springs.

The assembly 10 can be provided without the lost motion capability described above. To this end, link 72 will be without a slot 70 and connected directly and pivotally to tab 68, bearing 90 will be directly adjacent to surface 94 and bearing 102 will be have a portion directly adjacent to tab 68. Thus, for any rotation of member 18 under the influence of a manual force on door knob structure 16, there will be immediate retraction of tab 22 without any movement of tab 68 relative to link 72 longitudinally of the latter.

I claim:

1. A latch assembly for a door having a mortise, an end face and a pair of aligned holes on opposite sides of the mortise comprising:

a support having an end margin;

a latch plate at the end margin of the support, said support being of a size sufficient to allow the support to be inserted into the mortise in the door with the latch plate extending along the end face of the door, said support having a hole therethrough for alignment with the holes of the door when the support is in the mortise;

a member of a material permitting light to pass therethrough;

means mounting the member for rotation about an axis extending through the hole in the support;

means coupled with the member for permitting rotation of the member, said hole in the support being larger than the area of coupling of the knob means to the member, whereby light from one side of the support can pass directly through the member and the hole in the support;

a latch bolt shiftably mounted on the latch plate and movable from an extended position to a retracted position;

means coupled with the latch bolt for shifting the latch bolt into its retracted position in response to the rotation of the member about said axis in either direction; and means coupled with the latch bolt for biasing the lattter into said extended position.

2. A latch assembly as set forth in claim 1, wherein the member is transparent.

3. A latch assembly as set forth in claim 1, wherein said member is translucent.

4. A latch assembly as set forth in claim 1, wherein the member is disc-shaped.

5. A latch assembly as set forth in claim 1, wherein the member is cylindrical, said axis being the central axis of the member.

6. A latch assembly as set forth in claim 1, wherein said member is formed of glass.

7. A latch assembly as set forth in claim 1, wherein said member is formed from tempered glass.

8. A latch assembly as set forth in claim 1, wherein said member is formed of plastic material.

9. A latch assembly as set forth in claim 1, wherein said member is provided with a cylindrical outer periphery, said mounting means including a number of spaced bearings carried by the support and located adjacent to the outer periphery of the member.

10. A latch assembly as set forth in claim 1, wherein the support comprises a plate having a flat inner surface, said member having a flat face in substantial juxtaposition to the inner surface of the plate.

11. A latch assembly as set forth in claim 1, wherein said shifting means includes a link shiftably mounted on the support, one end of the link being coupled to the latch bolt, and means carried by the member and coupled with the link for shifting the link and thereby the latch bolt relative to the support in response to the rotation of the member about said axis.

12. A latch assembly as set forth in claim 11, wherein said means coupled with the link includes a rigid tab extending radially outwardly from the member.

13. A latch assembly as set forth in claim 12, wherein said tab is connected directly to the link to permit movement of the link in response to the movement of the tab.

14. A latch assembly for a door having a mortise, an end face and a pair of aligned holes on opposite sides of the mortise comprising:

a support having an end margin;

a latch plate at the end margin of the support, said support being of a size sufficient to allow the support to be inserted into the mortise in the door with the latch plate extending along the end face of the door, said support having a hole therethrough for alignment with the holes of the door when the support is in the mortise;

a member of a material permitting light to pass therethrough, said member having a cylindrical outer periphery;

a number of spaced bearings carried by the support and located adjacent to the outer periphery of the member for mounting the member for rotation about an axis extending through the hole in the support, each bearing including a roller rotatably mounted on the support;

a latch bolt shiftably mounted on the latch plate and movable from an extended position to a retracted position;

means coupled with the latch bolt for shifting the same into its retracted position in response to the rotation of the member about said axis in either direction; and means coupled with the latch bolt for biasing the latter into said extended position.

15. A latch assembly for a door having a mortise, an end face and a pair of aligned holes on opposite sides of the mortise comprising:

a support having an end margin;

a latch plate at the end margin of the support, said support being of a size sufficient to allow the support to be inserted into the mortise in the door with the latch plate extending along the end face of the door, said support having a hole therethrough for alignment with the holes of the door when the support is in the mortise;

a member of a material permitting light to pass therethrough;

means mounting the member for rotation about an axis extending through the hole in the support;

a latch bolt shiftably mounted on the latch plate and movable from an extended position to a retracted position;

a link shiftably mounted on the support, one end of the link being coupled with the latch bolt;

a rigid tab extending radially outwardly from the member and coupled with the link for shifting the link and thereby the latch bolt relative to the support into its retracted position in response to the rotation of the member about said axis in either direction, the link having a slot therein, said tab extending through the slot and movable along the slot relative to the link, there being bearing means for causing movement of the link and thereby movement of the latch bolt after the tab has moved a certain distance in either direction along the slot; and means coupled with the latch bolt for biasing the latter into said extended position.

16. A latch assembly as set forth in claim 15, wherein said bearing means includes a first bearing on one side of the tab and a second bearing on the opposite side of the tab, the bearings being coupled to the link, and means on the tab for alternately engaging the first and second bearings as a function of the movement of the tab in opposite directions about the axis.

17. A latch assembly as set forth in claim 16, wherein said first bearing has an inclined bearing surface, said tab having a bearing element adjustably mounted thereon and engageable with the bearing surface of said first bearing.

18. A latch assembly as set forth in claim 17, wherein the tab includes a slot therein, said bearing element having means extending through the slots for adjustably mounting the bearing element on the tab.

19. A latch assembly as set forth in claim 16, wherein said first bearing is pivotally mounted on the support intermediate ends thereon, the second bearing being rigidly coupled to the link.

20. A latch assembly for a door having a mortise, an end face and a pair of aligned holes on opposite sides of the mortise comprising:

a support having an end margin;

a latch plate at the end margin of the support, said support being of a size sufficient to allow the support to be inserted into the mortise in the door with the latch plate extending along the end face of the door, said support having a hole therethrough for alignment with the holes of the door when the support is in the mortise;

a member of a material permitting light to pass therethrough;

means mounting the member for rotation about an axis extending through the hole in the support;

a latch bolt shiftably mounted on the latch plate and movable from an extended position to a retracted position;

means coupled with the latch bolt for shifting the same into its retracted position in response to the rotation of the member about said axis in either direction; and a spring coupled with the latch bolt for biasing the latter into said extended position.

21. A latch assembly for a door having a mortise, an end face and a pair of aligned holes on opposite sides of the mortise comprising:

a support having an end margin;

a latch plate at the end margin of the support, said support being of a size sufficient to allow the support to be inserted into the mortise in the door with the latch plate extending along the end face of the door, said support having a hole therethrough for alignment with the holes of the door when the support is in the mortise;

a member of a material permitting light to pass therethrough;

means mounting the member for rotation about an axis extending through the hole in the support;

a latch bolt shiftably mounted on the latch plate and movable from an extended position to a retracted position;

means coupled with the latch bolt for shifting the same into its retracted position in response to the rotation of the member about said axis in either direction; and a pair of springs coupled with the latch bolt for biasing the latter into said extended position, there being a tab mounted on the members and extending outwardly therefrom, the springs being on respective sides of the tab, each spring being compressed when the tab moves in a respective direction about said axis.

22. A latch assembly as set forth in claim 1, wherein is included a door having a mortise, an end face and pair of aligned holes on opposite sides of the mortise, said support being in the mortise with the latch plate extending along the end plates of the door and with the hole in the support aligned with the holes of the door.

* * * * *